US008790071B2

(12) United States Patent
Oishi

(10) Patent No.: US 8,790,071 B2
(45) Date of Patent: Jul. 29, 2014

(54) TURBOMOLECULAR PUMP

(75) Inventor: Kouta Oishi, Aichi (JP)

(73) Assignee: Shimadzu Corporation, Kyoto-shi (JP)

( * ) Notice: Subject to any disclaimer, the term of this patent is extended or adjusted under 35 U.S.C. 154(b) by 785 days.

(21) Appl. No.: 13/122,344

(22) PCT Filed: Oct. 5, 2009

(86) PCT No.: PCT/JP2009/067356

§ 371 (c)(1),
(2), (4) Date: Jun. 10, 2011

(87) PCT Pub. No.: WO2010/038896

PCT Pub. Date: Apr. 8, 2010

(65) Prior Publication Data

US 2011/0236196 A1 Sep. 29, 2011

(30) Foreign Application Priority Data

Oct. 3, 2008 (JP) ..... 2008-258054

(51) Int. Cl.

| | |
|---|---|
| ***F01D 1/02*** | (2006.01) |
| ***F04D 29/32*** | (2006.01) |
| ***F04D 29/54*** | (2006.01) |
| ***F04D 19/04*** | (2006.01) |

(52) U.S. Cl.

CPC ..... *F04D 19/042* (2013.01); *F04D 29/324* (2013.01); *F04D 29/542* (2013.01)

USPC ..... 415/90; 415/199.5

(58) Field of Classification Search

USPC ..... 415/55.1, 55.5, 55.6, 58.7, 59.1, 199.5, 415/209.1

See application file for complete search history.

(56) References Cited

U.S. PATENT DOCUMENTS 6,499,942 B1 12/2002 Nonaka et al.

FOREIGN PATENT DOCUMENTS

| | | | |
|---|---|---|---|
| JP | 8-247084 | A | 9/1996 |
| JP | 2003-013880 | A | 1/2003 |

OTHER PUBLICATIONS

International Search Report of PCT/JP2009/067356, mailing date of Nov. 17, 2009.

*Primary Examiner* — Edward Look
*Assistant Examiner* — Maxime Adjagbe
(74) *Attorney, Agent, or Firm* — Westerman, Hattori, Daniels & Adrian, LLP

(57) ABSTRACT

In a turbomolecular pump, in connection with a dimensionless number X that is the ratio of an inter-vane distance S to a chord length C for moving vane blades of rotor impeller (4B) and stationary vane blades of stator impeller (2B), with dimensionless numbers at the outer circumferential portion and the inner circumferential portion of a first vane stage being termed Xo(R) and Xi(R) and dimensionless numbers at the outer circumferential portion and the inner circumferential portion of a second vane stage being termed Xo(S) and Xi(S), and with respect to vane stages that are adjacent along the direction of the rotational shaft, at least one vane stage is provided that satisfies a first relational equation "Xo(R)>Xo(S)" and a second relational equation "Xi(R)<Xi(S)". As a result it is possible to enhance the evacuation performance, in particular the evacuation performance in the high flow rate region, as compared to a prior art turbomolecular pump in which the vane design has been performed according to a two-dimensional cross sectional vane model.

15 Claims, 8 Drawing Sheets

TURBOMOLECULAR PUMP

TECHNICAL FIELD

The present invention relates to a turbomolecular pump whose high flow rate performance is excellent.

BACKGROUND ART

In the prior art, in the design of the rotor vanes and the stator vanes of a turbomolecular pump, a two-dimensional cross sectional vane shape like that shown in FIG. 2 has been investigated as a model. One guide when designing a vane is the dimensionless number X that is the ratio between the inter-vane distance S and the chord length C, and the exhaust performance depends upon this dimensionless number X.

In the prior art, when applying a two dimensional cross sectional vane model, the rotor vanes and the stator vanes are considered as being equivalent, and vane design is performed for both of them with the same design principle. As such design principle, for example, the method of executing the design so that the dimensionless number X becomes the same for all the stages, and the method of executing the design so that the dimensionless number for each of the vane stages changes linearly from the pump inlet side towards its outlet side, and so on are known (refer to Patent Document #1).

CITATION LIST

Patent Literature

Patent Document #1: Japanese Laid-Open Patent Publication 2003-13880.

SUMMARY OF INVENTION

Technical Problem

However, since analysis according to the prior art theory and design method used in such a two dimensional cross sectional vane model is executed while only taking into consideration the movement of molecules within the cross section (i.e. in two dimensions), accordingly some deviations from reality occur. Due to this there has been the problem that, although demands upon turbomolecular pumps suited for high flow rate evacuation and high back pressure are growing, it has not been possible sufficiently to address these demands with such prior art design according to a two dimensional cross sectional vane model.

Solution to Problem

A turbomolecular pump according to the present invention comprises a plurality of first vane stages each of which comprises a plurality of moving vane blades formed so as to extend radially from a rotating assembly, and a plurality of second vane stages each of which consists of a plurality of stationary vane blades arranged so as to extend radially with respect to a rotation shaft of the rotating assembly, arranged alternately; and including, with respect to the vane stages that are adjacent along the rotation shaft direction, at least one vane stage that satisfies a first relational equation "$Xo(R)>Xo(S)$" and a second relational equation "$Xi(R)<Xi(S)$" in connection with a dimensionless number X that is a ratio of an inter-vane distance S to a chord length C for the moving vane blades and the stationary vane blades, with the dimensionless numbers at an outer circumferential portion and an inner circumferential portion of the first vane stage being termed Xo(R) and Xi(R) and the dimensionless numbers at an outer circumferential portion and an inner circumferential portion of the second vane stage being termed Xo(S) and Xi(S).

The vane stage that satisfies the first and second relational equations may also satisfies a third relational equation "$Xi(S)<Xo(S)<Xi(S)\times 1.5$".

The vane stage that satisfies the first and second relational equations may also satisfies, in relation to adjacent vane stages, a fourth relational equation "$Xo(S)<Xo(R)<Xo(S)\times 1.5$" and a fifth relational equation "$Xi(S)>Xi(R)>Xi(S)\times 0.5$".

Further, being a vane stage that satisfies the relational equations may apply to at least one of a plurality of vane stages that handle an intermediate flow region, or being a vane stage that satisfies the relational equations may apply to at least half of the vane stages, among the plurality of vane stages, that are disposed at outlet side, or being a vane stage that satisfies the relational equations also applies to all of the vane stages, except for that vane stage that is provided closest to the inlet side in the axial direction.

Furthermore, among the plurality of second vane stages, at least the vane stages that satisfy the relational equations may be made by a die-casting method.

Advantageous Effect of Invention

According to the present invention, it is possible to enhance the evacuation performance, and in particular the evacuation performance in the high flow rate region.

DESCRIPTION OF EMBODIMENT

Figure 1:
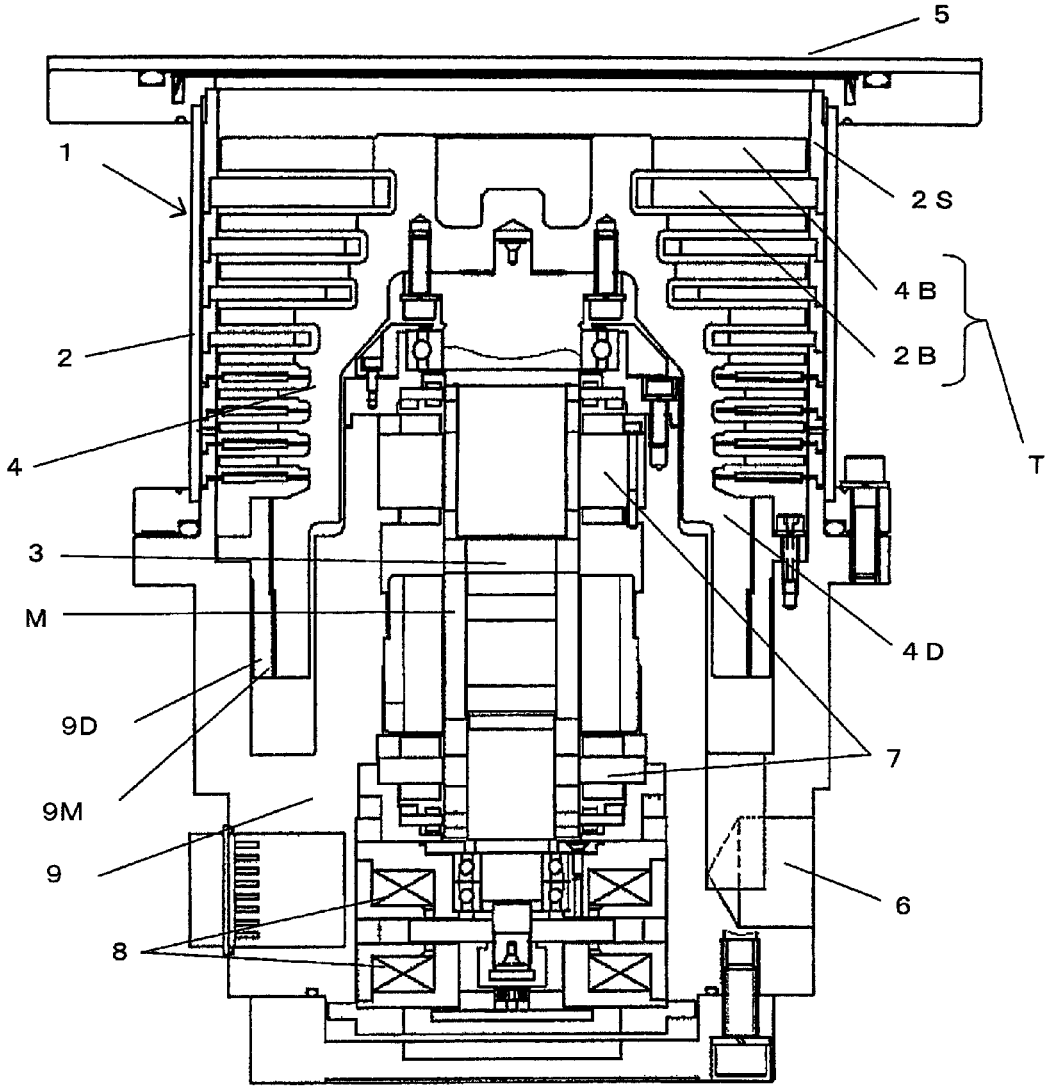
FIG. 1 is a figure showing an embodiment of the turbomolecular pump according to the present invention, and shows a cross section of a pump main body.

In the following, a preferred embodiment of the invention will be described with reference to the figures. FIG. 1 is a figure showing an embodiment of the turbomolecular pump according to the present invention, and is a sectional view of a pump main body 1. This turbomolecular pump is made up of the pump main body 1, shown in FIG. 1, and a controller (not shown in the figures) that supplies power to the pump main body 1 and controls its rotary driving.

A rotating assembly 4 is provided internally to a casing 2 of the pump main body 1, and a shaft 3 is engaged to this rotating assembly 4 by bolts. The shaft 3 is supported in a non-contact manner by upper and lower pairs of radial magnetic bearings 7 provided to a stator column and by thrust magnetic bearings 8 provided on a base 9, and is rotationally driven by a motor M.

Several stages of rotor impeller 4B and a rotating cylinder portion 4D are formed on the rotating assembly 4. On the other hand, a plurality of annular spacers 2S are stacked within the casing 2, and several stages of stator impeller 2B are provided so as to be held between these spacers 2S, that are above and below them. Furthermore, a fixed cylinder portion 9D is provided below the multiple stator impeller stages 2B, with a helical groove being formed upon its inner circumferential surface. Each of the rotor impeller sets 4B and each of the stator impellers 2B is composed of a plurality of vane blades that are formed so as to extend radially. It should be understood that, in this embodiment, eight of the rotor impellers 4B and eight of the stator impellers 2B are provided.

A turbine wheel section T is constituted by the multiple stages of rotor impellers 4B and the multiple stages of stator impellers 2B, and these are arranged alternately along the axial direction. On the other hand, the rotating cylinder portion 4D and the fixed cylinder portion 9D constitute a molecular drag pump section. The rotating cylinder portion 4D is provided so as to be close to the inner circumferential surface of the fixed cylinder portion 9D, and a helical groove 9M is formed upon the inner circumferential surface of the fixed cylinder portion 9D. In this molecular drag pump section, gas is evacuated due to the cooperation between the helical groove 9M of the fixed cylinder portion 9*d* and the rotating cylinder portion 4D that rotates at high speed.

A turbomolecular pump in which a turbine wheels section T and a molecular drag pump section are combined in this manner is termed a wide range type turbomolecular pump. It should be understood that the rotating assembly 4 is made from a metallic material such as aluminum alloy or the like, so that it can stand up to rotation at high speed.

Figure 2:
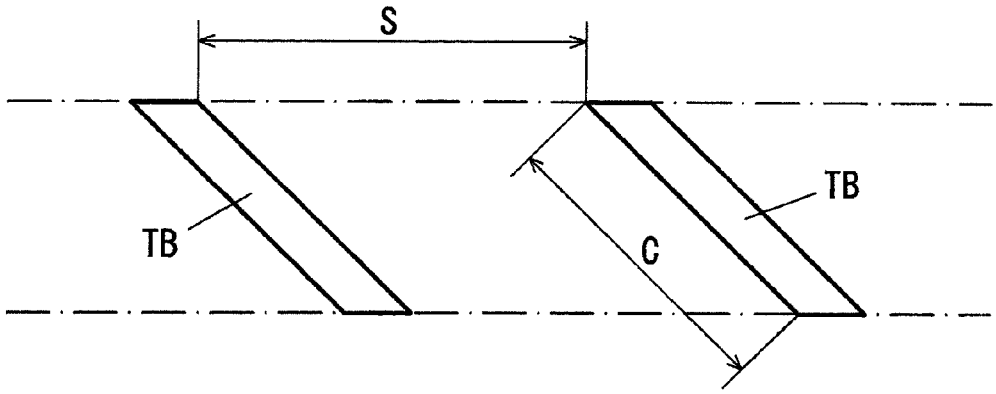
FIG. 2 is a figure showing a two dimensional cross sectional vane model.

FIG. 2 is a figure showing the two dimensional cross sectional vane model described above. FIG. 2 is a cross section of one of the rotor impeller 4B in its circumferential direction, and shows the relationship between two adjacent vane blades TB. When employing this two dimensional cross sectional vane model, the performance of the vanes (i.e. of the rotor impeller 4B and the stator impeller 2B) is determined by the relative speeds in two dimensions of the vanes and of the gas molecules, and by a dimensionless number X=S/C. S is the distance between the vanes, and C is the chord length of the vanes.

Figure 3:
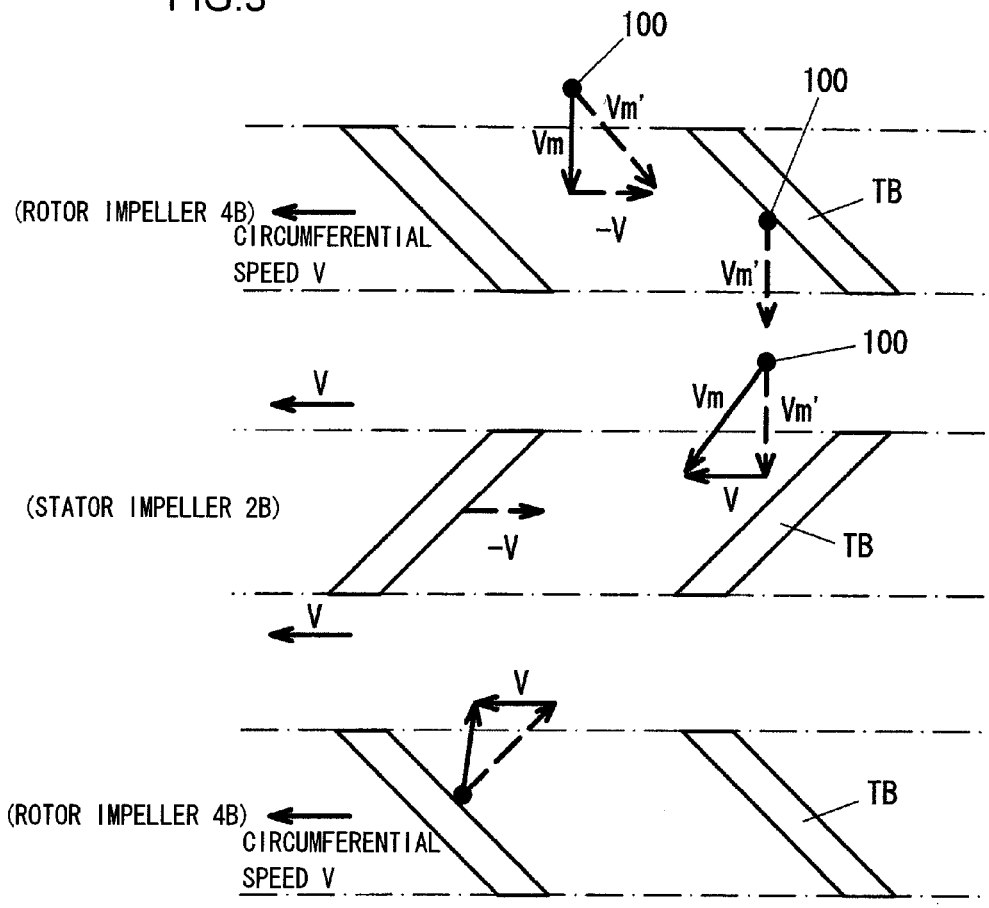
FIG. 3 is a figure showing how evacuation performance is to be investigated in this two dimensional cross sectional vane model.

FIG. 3 is a figure showing how evacuation performance is to be investigated when the model shown in FIG. 2 is employed. In FIG. 3, the upper and lower portions show two of the rotor impellers 4B, while the central portion shows one of the stator impeller 2B. It is supposed that the rotor impeller 4B is rotating leftwards as seen in the figure at a circumferential speed V. If a gas molecule 100 having a speed Vm downwards in the vertical direction is incident upon a rotor impeller 4B, the speed Vm' of this gas molecule relative to the rotor impeller 4B is the vector sum of the speed Vm and the speed (−V). Due to this, if the rotor impeller 4B is considered as being stationary, then a speed vector of (−V) in the circumferential direction is imparted by the rotation to the gas molecule, so that it is incident slanted upon the rotor vane 4B.

Next, consider a gas molecule 100 that collides with one of the vane blades TB of a rotor impeller 4B, and that has been expelled from the region of the rotor impeller 4B in the direction towards the stator impeller 2B. The relative speed of this gas molecule with respect to the rotor impeller 4B is taken as being Vm', and the rotor impeller 4B is rotating at the circumferential speed V with respect to the stator impeller 2B. Due to this, as seen from the stator impeller 2B that is stationary, the gas molecule has a speed Vm that is the vector sum of its relative speed Vm' and the circumferential speed V. The same also holds for a gas molecule that is expelled from the space below the stator impeller 2B (i.e. the region of the rotor impeller 4B).

In this manner, overall, a speed vector V in the leftward direction in the figure is imparted to the gas molecule 100 from the rotor impeller 4B, and the space above and below the stator impeller 2B may be considered as shifting with the circumferential speed V. In other words, if there are rotor impellers both above and below the stator impeller 2B, then this may be considered as being equivalent to the case in which, in the state in which there are no such rotor impellers 4B, the stator impeller 2B is rotating in the rightwards direction in the figure with a circumferential speed (−V). Due to this, by setting the inclination of the vane blades TB of the stator impeller 2B to be opposite to the inclination of the vane blades TB of the rotor impeller 4B, it is possible to consider the rotor impeller 4B and the stator impeller 2B as being equivalent. Due to this fact, in the prior art, it has been supposed that the design principles for the rotor impeller 4B and the stator impeller 2B should be the same.

However there are a large number of parameters that contribute to pump performance, such as the fact that the gas molecules actually move in three dimensions, the influence of the gaps present at the inner circumferential portions and the outer circumferential portions of the vane stages, collisions between molecules in the intermediate flow region, and so on. In this embodiment it is contemplated to enhance the performance, and in particular the performance as a high flow rate pump, by optimizing the shapes of the vanes in consideration of these influences as well.

Since fundamentally the evacuation performance of a turbomolecular pump is determined by the value "(evacuation gas flow amount of the vanes"-"reverse flow amount)", accordingly enhancement of the evacuation performance is arrived at by increasing the evacuation gas flow amount and also by reducing the reverse flow amount. Since the dimensionless number X described above is a parameter that is related to the space between the vane blades, accordingly, when this dimensionless number X is made greater, the flow conducting area for the gas molecules (i.e. the aperture area of the vanes) becomes greater, and also the evacuation gas amount and the reverse flow amount are increased. By adjusting X to the optimum value in consideration of this tradeoff relationship, it is possible to obtain the dimensionless number X for which the evacuation performance becomes the greatest. However, in the theoretical calculation according to the two dimensional cross sectional model, consideration is accorded neither to the reverse flow amount due to the gap between the internal and external peripheries, nor to the reverse flow amount due to the three dimensional movement of the gas molecules. Thus, in the embodiment explained below, it is contemplated to maximize the evacuation performance by adjusting the optimum dimensionless number X as obtained by the prior art theoretical calculation in consideration of the reverse flow amounts due to the gap and to three dimensional movement and so on.

In the following, the explanation will clarify this adjustment of the dimensionless number X in terms of the following three points. These are:

(1) Reduction of the influence of the gap;

(2) Adjustment due to the features of difference between the rotor vanes and the stator vanes; and (3) Adjustment in consideration of differences between the benefits provided by the different vane stages.

These will now be explained in the above order.

(1: Reduction of the Influence of the Gap)

Figure 4:
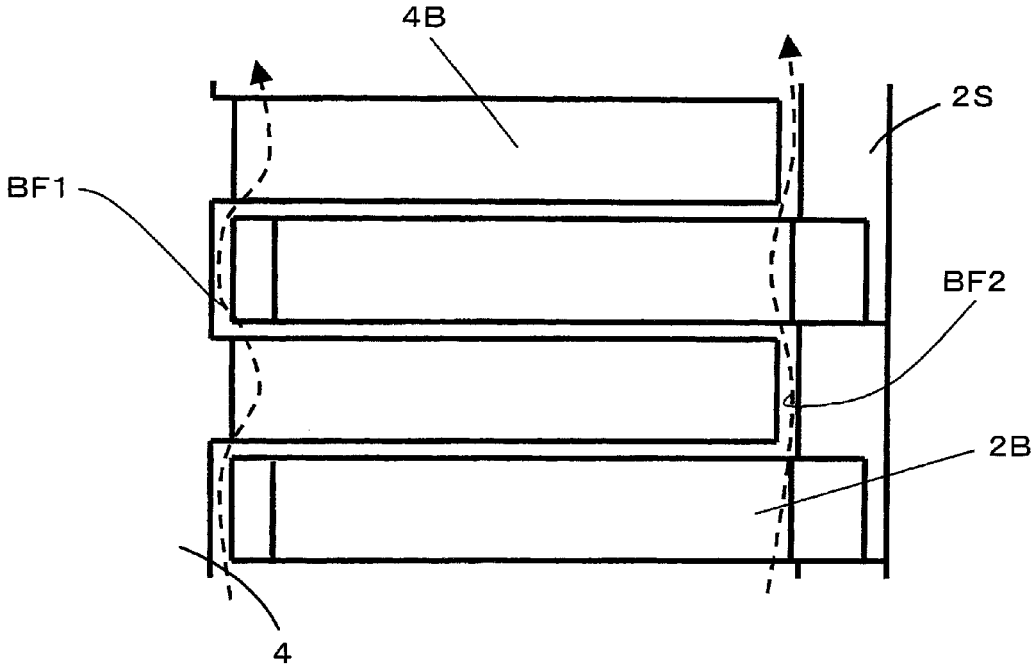
FIG. 4 is a figure for explanation of reverse flow of gas molecules.
Figure 5:
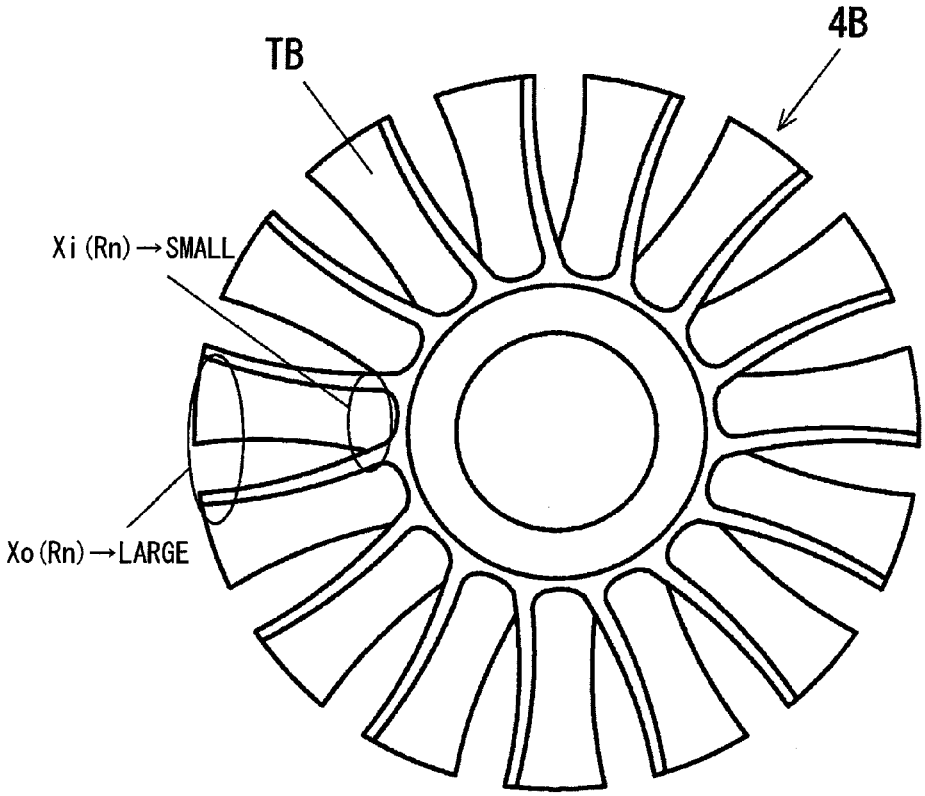
FIG. 5 is a plan view of a rotor impeller.
Figure 6:
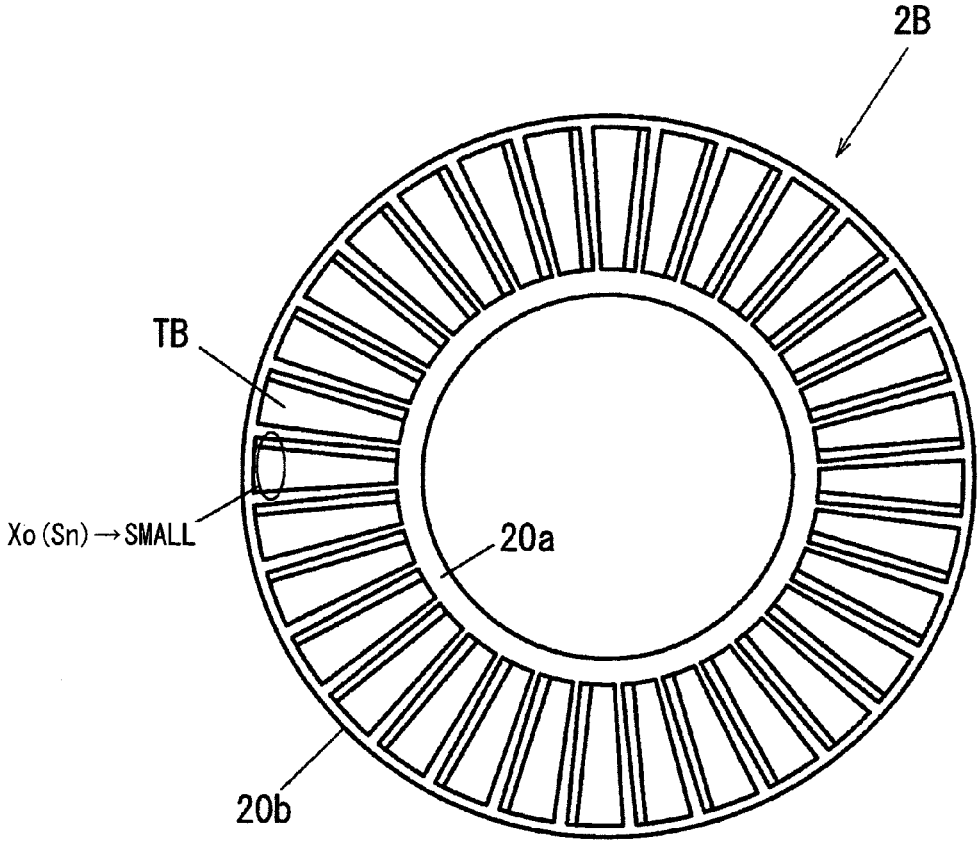
FIG. 6 is a plan view of a stator impeller.

FIG. 4 is a figure showing a cross section taken in the radial direction of portions of the rotor impeller 4B and the stator impeller 2B of the turbomolecular pump shown in FIG. 1. Moreover, FIG. 5 is a plan view of one of the rotor impellers 4B, and FIG. 6 is a plan view of one of the stator impellers 2B. As shown in FIG. 4, certain clearances are opened up between the ends of the rotor impeller 4B and the spacers 2S, in other words at the external circumferences of the rotor impeller 4B. On the other hand, certain clearances are also opened up between ribs 20*a* at the internal periphery of the stator impeller 2B and the rotor impeller 4. These clearances must be provided in order for the rotating assembly 4 to be capable of rotation. In the case of the stator impeller 2B shown in FIG. 6, ribs 20*a* and 20*b* are provided at its internal periphery and at its external periphery.

When the dimensionless number X at the region of a stator impeller 2B facing such a clearance portion is large, the number of gas molecules BF2 that flow backwards straight towards the intake aperture increases. Due to this, the influence that the reverse flow amount at the clearance portion exerts upon decrease of performance becomes greater than at the other portions, i.e. at the vane blades of the rotor impeller 4B. Thus, in order to reduce the number of molecules BF2 that flow backwards in this clearance region, the dimensionless number Xo(Sn) at the external periphery of the stator impeller 2B is made to be smaller than the calculated value Xo(On) at the external vane circumferential portion obtained by theoretical calculation. It should be understood that the suffix n denotes which one of the stator impellers 2B or rotor impellers 4B is, in order from the inlet side. With the stator impeller 2B shown in FIG. 6, it is arranged to reduce the dimensionless number Xo(Sn) by setting the inter-vane distance S at its external peripheral region to be small. Due to this, the difference between the dimensionless number Xi(Sn) at the inner circumferential portions of the vanes and the dimensionless number Xo(Sn) at the outer circumferential portions of the vanes becomes small.

On the other hand, to consider the external peripheral region of the rotary vane set 4B, in addition to the gas molecules that are incident from the vertical direction, some gas molecules are also incident that are moving in the almost radial direction after having been reflected from the wall surface. However, if the probability is small that these gas molecules will be capable of being entered into the rotor impeller 4B, then those gas molecules that have not been capable of being entered into the rotor impeller 4B become reverse flow molecules BF2. Thus, in this embodiment, by making the dimensionless number Xo(Rn) at the outer circumferential portions of the rotor impeller 4B to be greater than the calculated value Xo(On) for this dimensionless number, it is arranged to make it easier for gas molecules from the wall surface to be entered into the rotor impeller 4B, thus reducing the number of the reverse flow molecules BF2. With the rotor impeller 4B shown in FIG. 5, it is arranged to make this dimensionless number Xo(Rn) small by setting the inter-vane distance at the external peripheral region to be small. It should be understood that, since with the theoretical calculation the rotor vanes and the stator vanes are considered as being equivalent, accordingly the calculated values for their dimensionless numbers are the same.

Next, the clearance at the internal periphery of the stator impeller 2B will be considered. In this case as well, it is also possible to apply an argument to the internal peripheral region where the rotor vanes oppose the internal peripheral gap, similar to the argument applied to the case of the external peripheral region where the stator vanes oppose the external peripheral gap. In other words, it is arranged to reduce the number of reverse flow molecules BF1 by making the dimensionless number Xi(Rn) at the inner circumferential portions of the rotor impeller 4B to be smaller than the calculated value Xi(On) for this dimensionless number. It should be understood that the case of the rotor impeller 4B differs from the case of the stator impeller 2B, by the feature that, due to centrifugal force, a speed component in the outer circumferential direction is imparted to the gas molecules that contact the vane blades. Due to this, if the dimensionless number Xi(Rn) is reduced so that the vane blades are closer together, then the probability that the gas molecules will collide with the vane blades is increased, and the proportion of the molecules that proceed towards the internal periphery becomes smaller. This fact also further enhances the beneficial effect for reducing the reverse flow.

In consideration of the fact that the calculated values Xi(On) and Xo(On) for the dimensionless number for the rotor impeller 4B and for the stator impeller 2B are the same values, when the plan of making adjustment to the calculated values Xi(On) and Xo(On) for the dimensionless number X is translated into a relationship relating to the dimensionless numbers X(R) and X(S) of a rotor impeller 4B and a stator impeller 2B that are vertically adjacent, the following Equations (1) and (2) result. It should be understood that Xi(R) and Xo(R) are the dimensionless numbers for the rotor impeller 4B and Xi(S) and Xo(S) are the dimensionless numbers for the stator impeller 2B, while the suffixes i and o denote the inner circumferential portions of the vanes and the outer circumferential portions of the vanes.

$$Xo(R)>Xo(S) \tag{1}$$

$$Xi(R)<Xi(S) \tag{2}$$

(2: Adjustment Due to the Features of Difference Between the Rotor Vanes and the Stator Vanes)

Since, as previously described, the evacuation speed depends not only upon the dimensionless number X but also upon the circumferential speed of the vanes, accordingly the dimensionless number X is optimized according to the circumferential speed. Since the circumferential speed of the rotor impeller 4B is proportional to the distance from its rotational center, accordingly the dimensionless number X must become greater at its external periphery than at its internal periphery. On the other hand, with the prior art theory, as shown in FIG. 3, the stator impeller 2B and the rotor impeller 4B are viewed as being equivalent, and so their dimensionless numbers are also made to be the same.

Now, as will be understood from FIG. 3, the gas molecules that are incident upon the stator impeller 2B from above in the figure are ones that have been reflected off the lower surfaces of the vane blades TB, while on the other hand the gas molecules that are incident thereupon from beneath are ones that have been reflected off the upper surfaces of the vane blades TB. Most of the gas molecules that have been reflected off the blade lower surfaces have speed vectors angled in the lower left direction, while most of the gas molecules that have been reflected off the blade upper surfaces have speed vectors angled in the upper right direction. Due to this, when the circumferential speed vectors are taken into account in these speed vectors, the relationship between the inclinations of the vanes of the stator impeller 2B and the distribution of the speed vectors Vm of the gas molecules is different for the gas molecules that are incident from above (on the inlet side) and for the gas molecules that are incident from below (on the outlet side). In other words, if a gas molecule is incident from below, the tendency for the magnitude of its speed vector Vm to be large is small, as compared with the case of a gas molecule that is incident from above.

Due to this, if it is considered that the number of gas molecules that are incident upon the stator impeller 2B from the inlet side and the number of gas molecules that are incident thereupon from the outlet side are equal, then, among the gas molecules that are incident upon the stator impeller 2B, only around half come to have the speed vector Vm as predicted by the theory. Since, in a conventional turbomolecular pump, the circumferential speed of the outer circumferential portions of the vanes is set to be around twice the circumferential speed of their inner circumferential portions, accordingly, if the circumferential speed of the inner circumferential portions of the vanes is taken as a reference (=1), then the circumferential speed increment for the outer circumferential vane portions with respect to the inner circumferential vane portions becomes 1. However when it is borne in mind that, as described above, only around half of the gas molecules have the speed vector Vm as predicted by the theory, then, with a speed gradient from the internal circumference towards the external circumference of around half, it is considered to be appropriate for the circumferential speed of the outer circumferential portions of the vanes to be around 1.5 times the circumferential speed of their inner circumferential portions. Accordingly, the dimensionless number Xo(Sn) at the outer circumferential portion of the stator impeller 2B is set to be around 1.5 times the dimensionless number Xi(Sn) at its inner circumferential portion.

Moreover, when a collision occurs between molecules from the rotor impeller 4B incident upon the stator impeller 2B or between molecules within the stator impeller 2B, then this constitutes a reason for decrease of the beneficial effect provided by the rotor impeller 4B imparting its circumferential speed vector. Due to this, when consideration is given to this type of collision between molecules, it would also be acceptable for the dimensionless number Xo(Sn) at the outer circumferential portions of the vanes to be made to be less than 1.5 times the dimensionless number Xi(Sn) at the inner circumferential portions of the vanes. The influence of this type of collision between molecules appears more prominently for vane stages towards the outlet side, where the pressure becomes higher. It should be understood that, since the circumferential speed of the rotor impeller 4B is higher towards their external circumferences, accordingly the magnitudes of the circumferential speed vectors imparted to the gas molecules by the rotor impeller 4B also become higher towards their external circumferences. Due to this, the dimensionless numbers Xi(Sn) and Xo(Sn) at the outer circumferential portions and at the inner circumferential portions of the stator impeller 2B are set so that "Xi(Sn)<Xo(Sn)". Finally, it is desirable that, in a stator impeller 2B, the dimensionless number X should be set according to the following Equation (3):

$$Xi(Sn)<Xo(Sn)<Xi(Sn)\times 1.5 \quad (3)$$

When the dimensionless numbers Xi(Rn) and Xo(Rn) of the rotor impeller 4B are expressed in relationship with an adjacent stator impeller 2B, and with consideration being accorded to Equation (3) as described above in connection with the stator impeller 2B in its relationship to Equations (1) and (2), the dimensionless numbers Xi(Rn) and Xo(Rn) are given by the following Equations (4) and (5):

$$Xo(S)<Xo(R)<Xo(S)\times 1.5 \quad (4)$$

$$Xi(S)>Xi(R)>Xi(S)\times 0.5 \quad (5)$$

(3: Adjustment in Consideration of Differences Between the Benefits Provided by the Different Vane Stages)

The influence of the above described reverse flow of gas molecules and of collisions between molecules is more prominent, the higher is the pressure. Due to this, the method described above for setting the dimensionless number X in this embodiment provides greater beneficial effects, the closer the vane stage is to the outlet side at which the pressure is higher. Generally, in the case of a turbomolecular pump such as the one of this embodiment, the performance in the molecular flow region is determined by approximately half of the plurality of vane stages in which a stator impeller 2B and a rotor impeller 4B are combined, in other words this performance is determined by approximately eight of the vane stages from the inlet side.

On the other hand, in the intermediate flow region between the molecular flow region and the viscous flow region, the influence of the eighth and subsequent vane stages towards the outlet side becomes great. And, during vane design as well, the design is performed on the assumption of this type of structure. Since the performance in the high flow rate state depends largely upon the performance in this intermediate flow region, accordingly the method described above for setting the dimensionless number X is effective for enhancing the performance at high flow rate. Due to this it is possible to obtain a sufficiently advantageous effect, even if it is arranged not to perform adjustment of the dimensionless number X described above for all of the vane stages, but rather to set the dimensionless number X on the basis of the prior art theory for the eight stages in the molecular flow region on the inlet side, and to perform adjustment of the dimensionless number X described above only for the eight stages on the outlet side in the intermediate flow region.

It should be understood that, since sixteen vane stages are used in the example shown in FIG. 1, accordingly approximately the eighth stage is considered as being the stage for the division between the molecular flow region and the intermediate flow region; but if, for example, fourteen vane stages were used, then approximately the seventh stage would be considered as being the stage for this division.

The rotor impeller 4B and the stator impeller 2B shown in FIGS. 5 and 6 are ones that are shown as examples based upon the design objectives described above. Since, along with the dimensionless number X for the rotor impeller 4B being adjusted to be smaller at the internal peripheral region, it is also adjusted to be greater at the internal peripheral region, accordingly its difference between the inner circumferential portions of the vanes and the outer circumferential portions of the vanes becomes greater. On the other hand, in the case of the dimensionless number X for the stator impeller 2B, its difference between the inner circumferential portions of the vanes and the outer circumferential portions of the vanes becomes smaller.

In the prior art the stator impeller 2B, in particular those of the vane stages at the outlet side whose vane angles are shallow, have generally been manufactured by a process of bending a metallic plate. However, in the case of the stator impeller 2B of this embodiment, as shown in FIG. 6, the difference between the dimensionless number Xo(Sn) at the inner circumferential portions of the vanes and the dimensionless number Xi(Sn) at the outer circumferential portions of the vanes is small. In the case of a sheet metal bending process, it is difficult to make the difference in the dimensionless numbers between the internal circumference and the external circumference small, and it is impossible to form the vane shape at the external circumference shown in FIG. 6. Due to this, in this embodiment, by forming the stator impeller 2B for all of the stages by die-casting, it becomes possible to manufacture stator impeller 2B having dimensionless numbers as described above. Of course, it would also be acceptable to manufacture the stator impeller, not by die-casting, but by a normal casting method.

It should be understood that, for the uppermost rotor impeller 4B and the lowermost stator impeller 2B among the plurality of vane stages, since now only one of the two vane stages that were adjacent is present on one side thereof, accordingly it is not possible to apply the above described way of thinking for the other vane stages just as it is in an exactly similar manner, and the adjustments need to be performed from a different standpoint.

Figure 7:
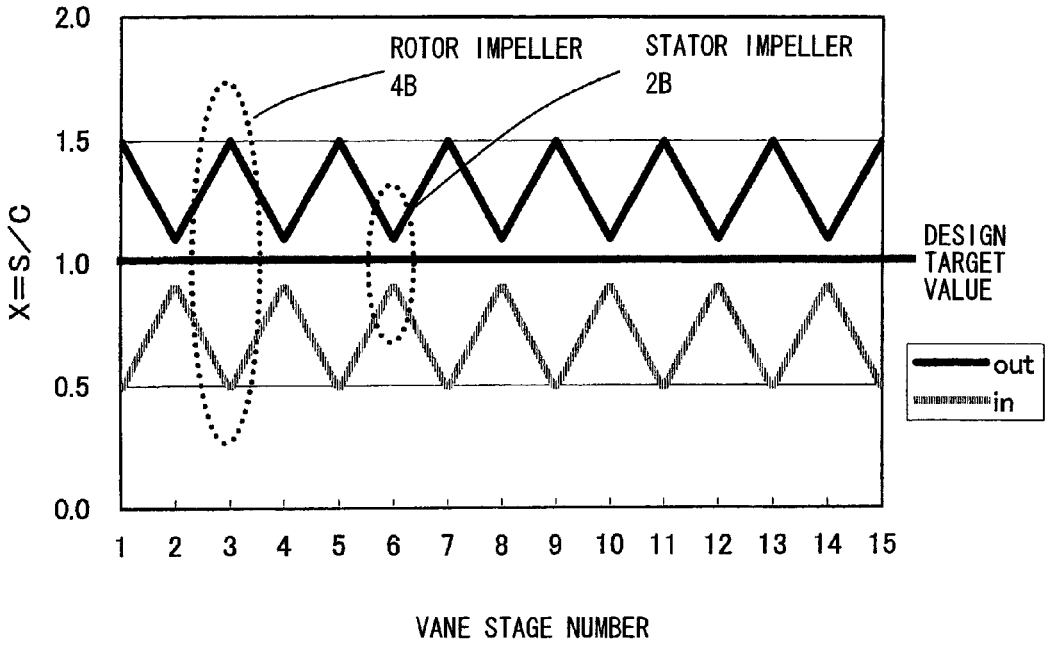
FIG. 7 is a figure showing an example of design of the dimensionless number X for vane stages from a first vane stage to a fifteenth vane stage.

FIG. 7 is a figure that shows an example of vane stage design according to the policy described above from the first stage to the fifteenth stage, i.e. excluding the sixteenth stage. In this figure, irrespective of which vane stage is concerned, all of the rotor impeller 4B are designed to have the same dimensionless numbers X as one another, and all of the stator impellers 2B are also designed to have the same dimensionless numbers X as one another. Moreover, the rotor impeller 4B of the first stage and the rotor impeller 4B of the second and subsequent stages are set to similar dimensionless numbers. The vertical axis in FIG. 7 shows the dimensionless numbers X for the vane inner circumferential portions (in) and for the vane outer circumferential portions (out), when the target design value is taken as being 1. The target design values are obtained by the prior art theory, and at intermediate positions on the vanes are the calculated values for the dimensionless numbers X.

Since the dimensionless numbers X are calculated so as to correspond to the mean free paths of the gas molecules, accordingly it is particularly appropriate for them to be determined by the region in which it is desired to evacuate the gas molecules. Since the influence due to three dimensional movement of the gas molecules such as reverse flow and so on is low at the vicinity of the intermediate regions of the vanes, accordingly the calculated values of the dimensionless number X calculated according to the prior art design theory may be used just as they are. If the calculated value of the dimensionless number X at the intermediate positions of the vanes is taken as being 1, then, when the proportion of the dimensionless number to the circumferential speed is considered, the calculated value Xi of the dimensionless number at the inner circumferential portions of the vanes becomes ⅔ (≈0.67), while the calculated value Xi of the dimensionless number at the outer circumferential portions of the vanes becomes ⅘ (≈1.33).

For the stator impeller 2B, the dimensionless number Xi(Sn) at the inner circumferential portions of the vanes is set to 0.8, while the dimensionless number Xo(Sn) at the outer circumferential portions of the vanes is set to 1.2, so that the dimensionless number Xo(Sn) at the outer circumferential portions of the vanes is set to 1.5 times the dimensionless number Xi(Sn) at the inner circumferential portions of the vanes. On the other hand, for the rotor impeller 4B, the dimensionless number Xi(Rn) at the inner circumferential portions of the vanes is set to 0.5, while the dimensionless number Xo(Rn) at the outer circumferential portions of the vanes is set to 1.5. The dimensionless numbers Xi(Sn) and Xo(Sn) of the stator impeller 2B are set so as to satisfy Equation (3), and, for this type of stator impeller 2B, the rotor impeller 4B are set so as to satisfy Equations (4) and (5).

Figure 8:
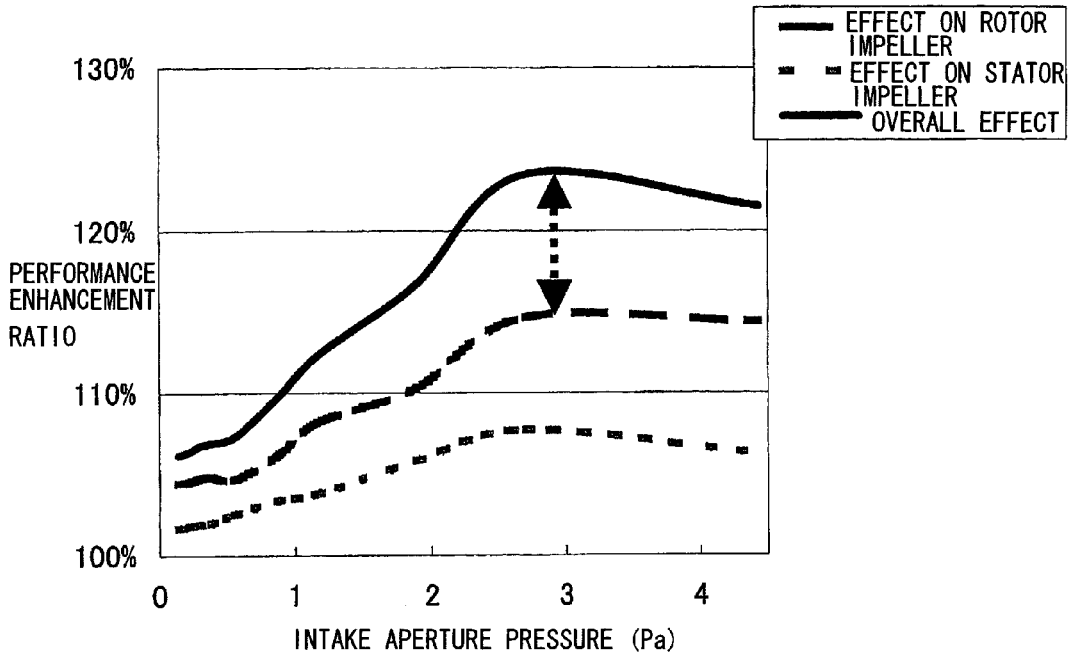
FIG. 8 is a figure for explanation of performance enhancement by adjustment of the dimensionless number X.

FIG. 8 is a figure showing the beneficial effect of the adjustment of the dimensionless numbers X described above. Here, the evacuation performance of a pump that has been designed by performing further adjustments is shown while taking as a standard the evacuation performance of a pump for which optimization has been performed according to the prior art design theory within the range of the condition "Xo(S)<Xo(R), Xi(S)>Xi(R)". Due to this, the vertical axis in FIG. 8 shows the enhancement ratio with respect to this standard performance, and a performance that is the same as the standard performance is shown as 100%.

The solid line shows the performance enhancement ratio of the improved device, and, for comparison, the enhancement ratio when only the stator impeller 2B are improved is shown by the dotted line, and the enhancement ratio when only the rotor impeller 4B are improved is shown by the broken line. In each case, the performance enhancement ratio becomes higher in the high flow rate state when the pressure is high, so that it is possible to anticipate performance enhancement for a high rate flow pump. It should be understood that while, in the example shown in FIG. 7, adjustment of the dimensionless number X described above was performed for the vane stages 1 through 15, it would also be acceptable to apply it to all of the vane stages 1 through 16, or to apply it to any one stage of the stages 1 through 16.

As described above, with the turbomolecular pump of this embodiment, with the dimensionless numbers at the outer circumferential portions and the inner circumferential portions of the vanes of the rotor impeller 4B being termed Xo(R) and Xi(R) and the dimensionless numbers at the outer circumferential portions and the inner circumferential portions of the vanes of the stator impeller 2B being termed Xo(S) and Xi(S), with respect to vane stages that are adjacent along the rotation shaft direction, by having at least one vane stage that satisfies a first relational equation "Xo(R)>Xo(S)" and a second relational equation "Xi(R)<Xi(S)", it is possible to anticipate enhancement of the evacuation performance without increasing the size of the device, and without adding any component of any special type.

Moreover, by making the vane stage that satisfies the first and second relational equations also satisfy a third relational equation "Xi(S)<Xo(S)<Xi(S)×1.5", and/or by making the vane stage that satisfies the first and second relational equations also satisfy, in relation to adjacent vane stages, a fourth relational equation "Xo(S)<Xo(R)<Xo(S)×1.5" and a fifth relational equation "Xi(S)>Xi(R)>Xi(S)×0.5", it is possible further to enhance the evacuation performance.

In particular, it is desirable for being a vane stage that satisfies the first and second relational equations also to apply to at least one of a plurality of vane stages that provide an intermediate flow region, or to at least half of the vane stages that are disposed at the outlet side. Moreover, by this feature applying to all of the vane stages, except for that vane stage that is provided closest to the inlet side in the axial direction, it is possible to anticipate yet further enhancement of the performance. Furthermore it is possible to perform manufacture of the stator vanes 2B in a simple and easy manner by, among the plurality of second vane stages, forming at least the vane stages that satisfy the above described relational equations by a die-casting method.

It would also be acceptable to utilize the embodiments described above either singly, or in combination. This is because it is possible to obtain the beneficial effect of each of the embodiments either singly or synergistically. Moreover, the above explanation is only given by way of example; the present invention is not limited to any of the embodiments described above, provided that the gist of the present invention is not lost. For example, it would also be possible to combine the variant embodiments together in any manner, and it would also be possible to apply the present invention to a turbomolecular pump other than one of the magnetic bearing type. Moreover while, in the example shown in FIG. 7, the dimensionless numbers X were applied from the first stage to the fifteenth stage with the same design objective, it would also be acceptable to arrange to change them linearly from the inlet side towards the outlet side, while still satisfying the relational equations described above.

The contents of the following application, upon which priority is claimed, are hereby included herein by reference: Japanese Patent Application 258,054 of 2008 (filed on 3 Oct. 2008).

The invention claimed is:

1. A turbomolecular pump comprising a plurality of first vane stages each of which comprises a plurality of moving vane blades formed so as to extend radially from a rotating assembly, and a plurality of second vane stages each of which consists of a plurality of stationary vane blades arranged so as to extend radially with respect to a rotation shaft of the rotating assembly, arranged alternately;

and including, with respect to the vane stages that are adjacent along the rotation shaft direction, at least one vane stage that satisfies a first relational equation "Xo(R)>Xo(S)" and a second relational equation "Xi(R)<Xi(S)" in connection with a dimensionless number X that is a ratio of an inter-vane distance S to a chord length C for the moving vane blades and the stationary vane blades, with the dimensionless numbers at an outer circumferential portion and an inner circumferential portion of the first vane stage being termed Xo(R) and Xi(R) and the dimensionless numbers at an outer circumferential portion and an inner circumferential portion of the second vane stage being termed Xo(S) and Xi(S).

2. A turbomolecular pump according to claim 1, wherein the vane stage that satisfies the first and second relational equations also satisfies a third relational equation "Xi(S)<Xo(S)<Xi(S)×1.5".

3. A turbomolecular pump according to claim 1, wherein the vane stage that satisfies the first and second relational equations also satisfies, in relation to adjacent vane stages, a fourth relational equation "Xo(S)<Xo(R)<Xo(S)×1.5" and a fifth relational equation "Xi(S)>Xi(R)>Xi(S)×0.5".

4. A turbomolecular pump according to claim 1, wherein being a vane stage that satisfies the relational equations applies to at least one of a plurality of vane stages that handle an intermediate flow region.

5. A turbomolecular pump according to claim 1, wherein being a vane stage that satisfies the relational equations applies to at least half of the vane stages, among the plurality of vane stages, that are disposed at outlet side.

6. A turbomolecular pump according to claim 1, wherein being a vane stage that satisfies the relational equations also applies to all of the vane stages, except for that vane stage that is provided closest to the inlet side in the axial direction.

7. A turbomolecular pump according to claim 1, wherein, among the plurality of second vane stages, at least the vane stages that satisfy the relational equations are made by a die-casting method.

8. A turbomolecular pump according to claim 2, wherein being a vane stage that satisfies the relational equations applies to at least one of a plurality of vane stages that handle an intermediate flow region.

9. A turbomolecular pump according to claim 3, wherein being a vane stage that satisfies the relational equations applies to at least one of a plurality of vane stages that handle an intermediate flow region.

10. A turbomolecular pump according to claim 2, wherein being a vane stage that satisfies the relational equations applies to at least half of the vane stages, among the plurality of vane stages, that are disposed at outlet side.

11. A turbomolecular pump according to claim 3, wherein being a vane stage that satisfies the relational equations applies to at least half of the vane stages, among the plurality of vane stages, that are disposed at outlet side.

12. A turbomolecular pump according to claim 2, wherein being a vane stage that satisfies the relational equations also applies to all of the vane stages, except for that vane stage that is provided closest to the inlet side in the axial direction.

13. A turbomolecular pump according to claim 3, wherein being a vane stage that satisfies the relational equations also applies to all of the vane stages, except for that vane stage that is provided closest to the inlet side in the axial direction.

14. A turbomolecular pump according to claim 2, wherein, among the plurality of second vane stages, at least the vane stages that satisfy the relational equations are made by a die-casting method.

15. A turbomolecular pump according to claim 3, wherein, among the plurality of second vane stages, at least the vane stages that satisfy the relational equations are made by a die-casting method.

* * * * *